US006285119B1

(12) United States Patent
Sundhar

(10) Patent No.: US 6,285,119 B1
(45) Date of Patent: Sep. 4, 2001

(54) LIGHT BULB HAVING INCREASED EFFICIENCY

(76) Inventor: Shaam Sundhar, 6 Tall Timbers Dr., Princeton, NJ (US) 08540

( * ) Notice: Subject to any disclaimer, the term of this patent is extended or adjusted under 35 U.S.C. 154(b) by 0 days.

(21) Appl. No.: 09/425,040

(22) Filed: Oct. 21, 1999

(51) Int. Cl.[7] ..... H01K 1/32

(52) U.S. Cl. ..... 313/318.04; 313/318.03; 313/578; 315/49; 315/307; 315/291

(58) Field of Search ..... 313/318.04, 318.05, 313/318.08, 318.09, 318.12, 318.03, 318.02, 578; 439/602, 611; 315/56, 49, 315, 291, 307, 306

(56) References Cited

U.S. PATENT DOCUMENTS 4,687,963 * 8/1987 Gagnon et al. ..... 313/579 X
5,008,587 * 4/1991 Bogris ..... 313/318.04 X
5,118,985 * 6/1992 Patton et al. ..... 313/578 X
5,218,261 * 6/1993 Start ..... 313/318.04 X

* cited by examiner

*Primary Examiner*—Ashok Patel
(74) *Attorney, Agent, or Firm*—Kremblas, Foster, Phillips & Pollick

(57) ABSTRACT

An electric lightbulb is provided for use with lightbulb sockets in either 110V or 220V screw type or bayonet circuits. The lightbulb includes a lamp portion and a cap portion, with the cap portion preferably containing circuitry. When the switch is on a high setting the lightbulb of this invention will last approximately twice as long as conventional incandescent bulbs, but at a low setting the bulb of this invention will last at least ten times as long as a conventional incandescent bulb. The lamp portion includes a filament attached to wires which are secured to the base of the lamp as well as to wires which are secured to an insulative sheath which is also held adjacent the base of the lamp. A metallic disk is maintained in contact with the sheath as well.

19 Claims, 3 Drawing Sheets

LIGHT BULB HAVING INCREASED EFFICIENCY

FIELD OF THE INVENTION

This invention relates to a lightbulb, and more particularly to one which has associated therewith increased efficiency and longer life when compared to existing incandescent lightbulbs.

BACKGROUND OF THE INVENTION

The efficacy, in terms of electrical efficiency, of an electrical luminary such as a lightbulb is obtained by dividing the total light output (lumens) by the power input (watts), thereby calculating the lumens per watt. As is well known, with conventional incandescent bulbs most of the energy input into a bulb ends up wasted as heat. In most cases the figure approximates 95% or greater. For this reason, a bulb that produces 720 lumens of light requires 60 watts, with a resulting efficacy of 12 lumens per watt. On the other hand, if none of the energy input into a bulb was lost as heat, then only one watt of electricity would produce a light output of 340 lumens!

There have been a number of attempts to solve the problem. For example, fluorescent bulbs have been developed as an alternative light source. However, some people do not care for the appearance of things when viewed in the light given off by these type of bulbs. Furthermore, many of the fluorescent lights which exist are incompatible with standard electrical light sockets. Those which are compatible and which are called compact fluorescent bulbs are often at least twenty times as costly as incandescent bulbs, and as such consumers have not found them to be a viable option. Yet another drawback associated with fluorescent bulbs is that they also contain phosphorus and mercury which raise environmental concerns.

Attempts have also been made to increase the life of incandescent lightbulbs, so that instead of the average life of 750 hours, a lightbulb may last over 1000 hours, with some being advertised as lasting up to 3000 hours. However, associated with lightbulbs which last longer is an increase in price. Still further, the efficacy of such lightbulbs is drastically reduced, since in order to obtain the same amount of light a higher power bulb using more electricity must be utilized.

Therefore it is apparent that the need exists for a simple, yet more efficacious electric lightbulb. It is also apparent that it would be even more desirable if such a lightbulb was also one having a life longer than that associated with such conventional bulbs.

SUMMARY OF THE INVENTION

In accordance with this invention, an electric lightbulb is provided which is more efficacious than standard lightbulbs. The lightbulb is comprised of a lamp and a cap. The lamp has a base with a bulb secured to the base. The base has connected thereto one end of a pair of lead wires, with the lead wires having their opposite ends connected to a filament. The filament is in contact with a gas. A portion of the pair of lead wires are encircled by glass, with the glass encircled by as well as having secured thereto a metallic disk. The cap contains electrical circuitry to reduce the voltage fed into the lamp.

The cap may either be of a screw-type for placement in a screw style electrical socket, or of bayonet-type for placement in a bayonet style electrical socket. The filament is a coiled coil, also being supported by a plurality of support wires, each of which support wires has one end in contact with the filament and another end in contact with the glass which encircles the lead wires.

In one embodiment of the invention, the glass comprises an inner stem and an outer stem. In this embodiment, the support wires are in contact with the inner stem, while the outer stem is secured to the base. The gas associated with this embodiment is a mixture of an inert gas and a halogen gas. More preferably, the gas is a mixture of xenon and bromine. Most preferably, the ratio of xenon to bromine is 98:2.

In another embodiment of the invention, the glass is an inner bulb secured to the base. The inner bulb contains a halogen gas. In this embodiment, the bulb encases the inner bulb and metallic disk. The bulb contains an inert gas, or alternatively contains air.

The cap comprises a housing having a switch to control the light output of the lamp. The base is secured within cap.

There is also disclosed a lightbulb having a lamp and a cap. The lamp has a base and a bulb secured to the base, the base having connected thereto one end of a pair of lead wires, with the lead wires having their opposite ends connected to a filament, with the filament being a coiled coil, and with the filament being in contact with a mixture of an inert gas and halogen gas. A portion of the pair of lead wires is encircled by glass. The filament is also supported by a plurality of support wires, each of which support wires has one end in contact with the filament and another end in contact with the glass which encircles the lead wires, with the glass comprising an inner stem and an outer stem, and the support wires being in contact with the inner stem, and with the outer stem being secured to the base. The glass is encircled by and has secured thereto a metallic disk. The cap contains electrical circuitry to reduce the voltage fed into the lamp.

The cap may be either a screw-type for placement in a screw style electrical socket, or a bayonet-type for placement in a bayonet style electrical socket.

There is also disclosed a lightbulb having a lamp and a cap. The lamp has a base with a bulb secured to the base, with the base having connected thereto one end of a pair of lead wires. The lead wires have their opposite ends connected to a filament, with the filament in contact with a gas. A portion of the pair of lead wires are encircled by glass, with the glass being an inner bulb containing a halogen gas. The inner bulb is secured to the base, and the glass is encircled by and has secured thereto a metallic disk, with the bulb encasing the inner bulb and the metallic disk. The bulb contains an inert gas or just air at a pressure of one atmosphere. The cap contains electrical circuitry to reduce the voltage fed into the lamp.

The primary objective of this invention is to provide an electric lightbulb that is significantly more efficacious than existing conventional incandescent lightbulbs.

Another objective is the providing of an improved electric lightbulb which not only enjoys a greater efficacy than standard lightbulbs, but also enjoys a longer life.

These and other objects and advantages of this invention will be apparent from the following description, the accompanying drawings and the appended claims.

DETAILED DESCRIPTION OF THE INVENTION

Figure 1:
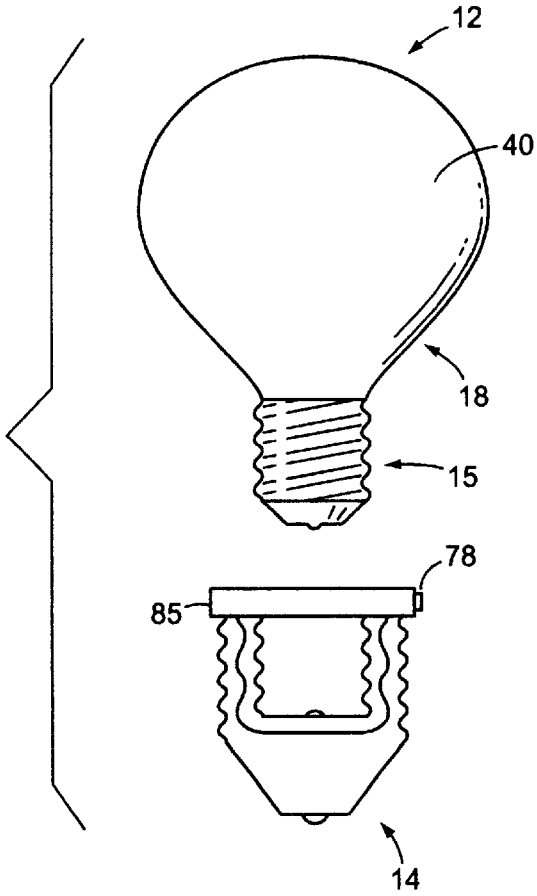
FIG. 1 is a front elevational view of the lightbulb made in accordance with the present invention.

Having reference to the drawings, attention is directed first to FIG. 1 which illustrates an electric lightbulb made in accordance with this invention and designated generally by the numeral 10. This lightbulb comprises a lamp 12 and a cap 14. As can be appreciated from a comparison of FIGS. 1 and 2, the lamp 12 has a base 15 secured to an outer bulb 18, a filament 20, wiring 22 completing a circuit of the type well known in the art from the base 15 to the filament 20 and then from the other end of the filament back to the base, and a plurality of support wires 25 one end of each support wire being connected to the filament with the other end being connected to a stem member 28.

The two lead wires 22 are made to pass through the hollow stem 28 which is preferably fabricated from glass, which glass stem is held in place by being secured within a second glass stem 29, the outer surface of which second stem 29 is secured to the conventional glass seal 30 in the base to which seal the bulb 18 is also secured. The bulb itself once secured to the base 15 is filled with a gas 40. Also secured to the exterior glass stem 29 is a disc member 35.

The life of a conventional incandescent bulb is dependent on the filament material, which is typically tungsten. The heat generated inside the incandescent bulb causes the tungsten to evaporate over time. The evaporation of the tungsten molecules ends up being deposited at the bottom of the bulb, thus causing used bulbs to appear somewhat black near the base. This black coating has the additional unpleasant consequence of further reducing the light output of the used bulb. As the filament loses more and more molecules to evaporation, it eventually breaks.

Figure 2:
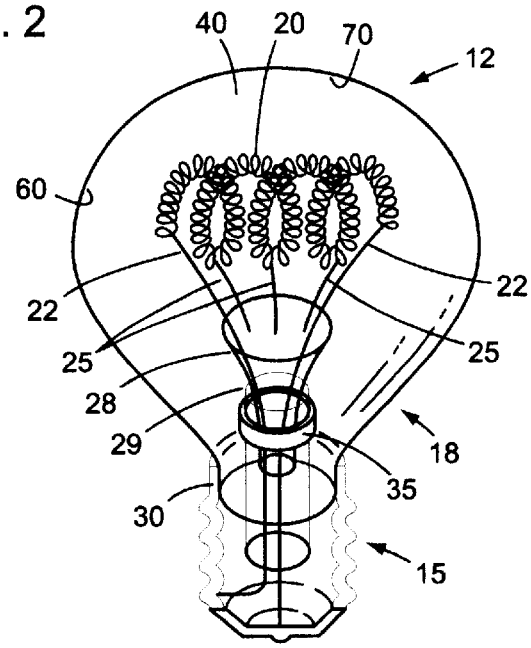
FIG. 2 is an exploded front elevational view on an enlarged scale of the preferred embodiment of the lamp component of the invention.

The filament 20 associated with the lightbulb of this invention is fabricated as can best be seen in FIG. 2 as a coiled coil. In other words, a straight wire is coiled, and then the coiled wire is coiled about itself to extend the distance between the two lead wires to which the opposite ends of the filament are secured. Moreover, the filament of this invention has a low impedance. It will also be appreciated that in addition to the two lead wires 22, a plurality of support wires 25 preferably at least three in number are provided to hold the filament 20 in place and minimize or altogether prevent its sagging, as well as to minimize the effect of vibration on the filament 20.

The metallic disc member 35 is affixed on the outside of stem 29 close to the screw portion of the lamp by means well known in the art, such as by an adhesive or by a friction-fit. In the preferred embodiment of the invention, the disc member 35 is a thin aluminum disc preferably 1/64" thick and 1" in diameter. The disc reflects heat back onto the filament, which then causes the temperature of the filament to increase. The increased temperature of the filament causes it to release more photons, which means that more light is produced than would otherwise by the case. More of this light is then reflected away from the lamp base.

Also on the interior surface of the bulb in the preferred embodiment of the invention is a reflective coating 60, with the reflective coating preferably extending from a place just beyond the filament 20 to the base of the bulb. This reflective coating 60 causes the light emitted towards the base to be reflected away from the base, so that more of the light actually emitted from the bulb is efficiently used. The remainder of the bulb surface may be coated with a light frosting or coating 70, so that the bulb appears frosted or, as some refer to it, so that the light is softened.

With respect to the base 15, it should be appreciated that the preferred embodiment of the invention uses an E-17 base, which is of an intermediate diameter. This is to prevent the direct use of the lamp in a E-26, standard sized light socket, where it would burn out much faster than intended. In fact, it would burn out very quickly due to the increased power input the lamp of this invention is not intended to use, and that is the reason for the circuitry within the cap 14 as will be discussed below.

With respect to the gas 40, it is not fluorescent, but preferably is a halogen gas, such as bromine, in combination with another gas such as xenon. In the preferred embodiment of the invention, the gas mixture is made up of a combination of bromine and xenon, an inert gas, in a ratio of 98 parts xenon to 2 parts bromine. It is believed that the xenon gas, due to its relatively heavy molecular weight, effectively "presses" against the filament so as to inhibit or slow the evaporation of the molecules from the filament, such as tungsten molecules. It is also believed that the bromine aids in the redeposition of filament molecules back onto the filament, thereby prolonging the life of the filament and consequently the bulb. Additionally, due to the interaction between the gas, or combination thereof, associated with this invention and the filament, the brightness of the bulb is also increased when compared to lightbulbs that do not incorporate the gas or gases herein disclosed.

Figure 3:
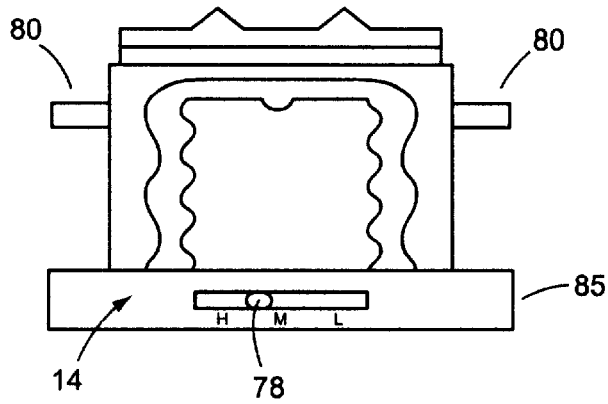
FIG. 3 is a front elevational view of a modified cap component of the invention.

Having discussed the lamp portion 12 of the invention, the cap portion 14 will now be discussed aided by a comparison of FIGS. 1 and 3. The cap 14 contains circuitry 75 to assist in achieving the objectives of this invention. Part of the circuitry is a switch 78 connected to a rheostat or variable resistor as shall be discussed below. The cap 14 accommodates the base 15 of the lamp, and as shown in FIGS. 1 and 3 respectively, provides for attachment to either a 110 V screw style or 220 V bayonet style socket. Thus it will be recognized that one of the lamps 12 could be used with both styled caps, either screw or bayonet type having pins 80. Both caps have a disc-shaped housing 85 preferably made of plastic, that is located directly adjacent the screwed in lamp. The housing 85 accommodates switch 78, plus circuitry 75 if needed.

When assembled, the overall length of the lightbulb of this invention is about the same as that of a regular 60 Watt incandescent lightbulb, so that it is easily used where conventional bulbs have been used. For example, in the preferred embodiment of this invention the diameter of the base of the lamp is 7/16" and the distance from where the lamp joins the base to the tip of the base is ½". With respect to the screw style of cap, the overall diameter is 15/16", and the overall height of the cap is 1 1/16". With respect to the bayonet style of cap, the overall diameter is 14/16" and the overall height of the cap is 10/16". Of course, it should be appreciated that the size of the lightbulb may vary so as to be easily substituted for bulbs of varying watts, as well as being of both the "A" and "Globe" shape of bulb.

Figure 4:
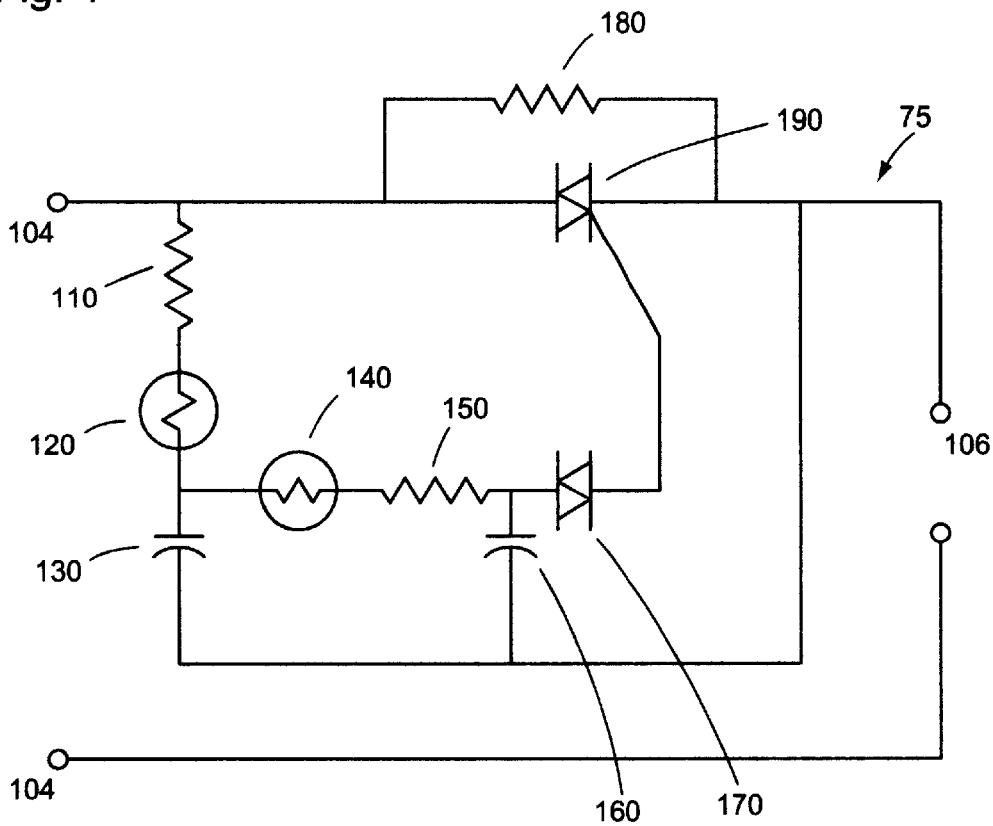
FIG. 4 discloses electrical circuitry associated with the invention.
Figure 5:
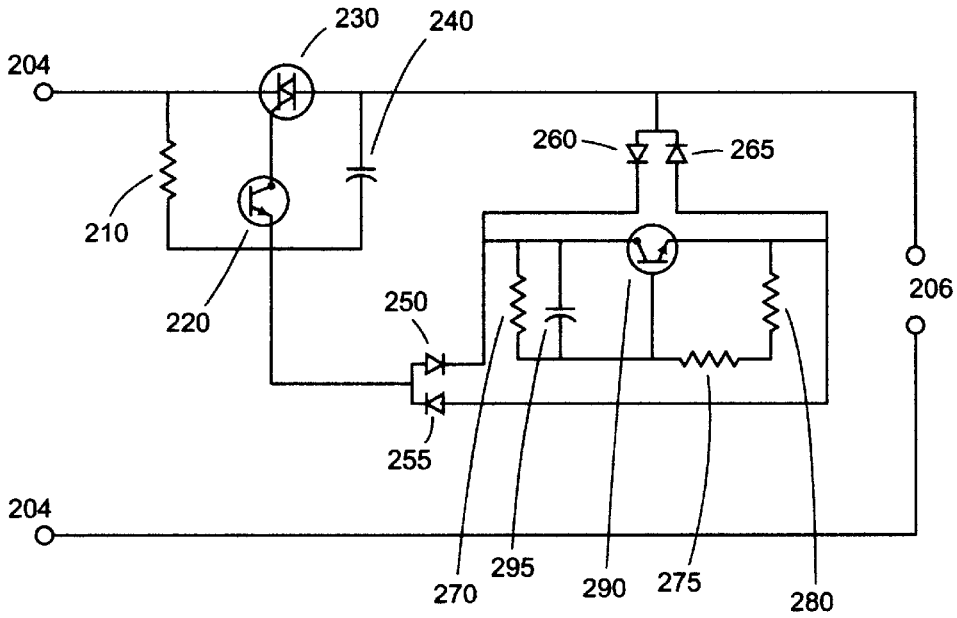
FIG. 5 discloses modified electrical circuitry associated with the invention.

Within the cap 14, an electronic circuit is mounted, with the circuit being of the type known as a phase control circuit. Examples of phase control circuits which could be used with the invention are shown in FIGS. 4 and 5. The primary purpose of these circuits is to reduce the line RMS voltage to the voltage that is actually fed into the lamp of this invention.

Turning now to FIGS. 4 and 5, in FIG. 4 the circuit is shown as having a current source connecting end 104 as well as a bulb connecting end 106. A resistor 110 is preferably a variable resistor connected to the switch 78 on the cap 14 in a manner well known in the art. The resistor is a ¼ to ½ watt and 50 to 220K, resistor with the resistor in the preferred embodiment being a ¼ watt, 120 K resistor. By changing the resistance, the light output changes. For example, increasing the resistance decreases the light output. The switch 78 is shown as having three positions, which in the preferred embodiment permit the resistor to provide light output corresponding to 100, 75, and 40 watts, although it could be made to be other combinations.

Connected to the variable resistor 110 is a thermistor 120. A source for this thermistor 120 is Keystone PNRL1004-104.7K-15501 or a similar thermistor. Thermistor 120 is directly connected to the resistor 110. The circuitry shown in FIG. 4 has a capacitor 130, preferably of the 200 volt ceramic type, and also with a preferred value of 0.01 mf connected to the thermistor 120. This circuit also has a second thermistor 140 of the same type as thermistor 120. Thermistor 140 is directly connected to resistor 150 which once again is a ¼ to ½ watt 50K resistor, with the preferred embodiment having values of ¼ watt and 120 K respectively. Another capacitor 160, which is also a high temperature capacitor, is connected to the circuit between resistor 150 and diac 170.

The electrical circuitry of FIG. 4 includes a heating resistor 180, which in this case is a ¼ watt 8.2K resistor, that is connected to the circuitry on each side of a triac 190. The triac 190 is also directly connected to diac 170, with the triac being similar to a Teccor Q200423 with a $V_{drm}$ equal to 200 to 400 volts and an $I_f$ of 4 to 8 Amps, however the values in the circuit shown in FIG. 4 are 200 volts and 4 Amps respectively. The diac in this embodiment is similar to a General Electric STU having a Vbr equal to 35–45 volts.

Turning now to FIG. 5, it may be appreciated that a circuit is disclosed wherein a current source connecting end 204 as well as a bulb connecting end 206. Resistor 210 is preferably a variable resistor of suitable value, and in the preferred embodiment of the invention can provide up to 18K of resistance. Connected to the resistor is a diac 220, preferably similar to a Teccor HT40. Also electrically connected to the diac is a triac 230 which is preferably similar to a Teccor Q2004L3. The electrical circuitry also comprises a capacitor 240, preferably a 0.1 mF capacitor.

The circuit shown in FIG. 5 also includes a pair of diodes 250, 255 connected in the circuit to another pair of diodes 260, 265. Intermediate the two pairs of diodes in the circuit are three resistors, 270, 275, and 280 respectively, having resistances of 4.7M, 2.2M and 2.7K respectively. All three of these resistors are connected to a transistor 290, and with a 1.0 mF capacitor 295 located adjacent resistor 270.

Although a high efficient "Torroid" transformer could also be used in place of an electronic circuit as another means to step down the line voltage, it consumes more energy in the transformer than does the preferred embodiment of the invention. Yet another alternative would be to convert the line AC voltage into DC positive pulses by using a bridge rectifier or two diodes. For a 110 V line RMS voltage, the rectified positive DC will have a peak of about 156 V. A DC to DC converter may also be used to further reduce the voltage which is fed into the lamp of this invention.

Utilization of the above design improvements results in a lightbulb having a dramatically improved efficacy. For example, a lightbulb which produces 720 lumens of light may be fabricated according to this invention so as to only require 32 watts. The savings in energy of 46% is accomplished without diminishing the light output. Meanwhile, lightbulbs made in accordance with this invention typically will have at least twice the life of conventional incandescent bulbs. Indeed, it is possible to manufacture a lightbulb using the disclosed invention which results in a lightbulb with a life in excess of 40,000 hours when the switch is set at a "low" setting so as to use less power. Thus lightbulbs made utilizing this invention not only have a higher efficacy, but a longer life.

Figure 6:
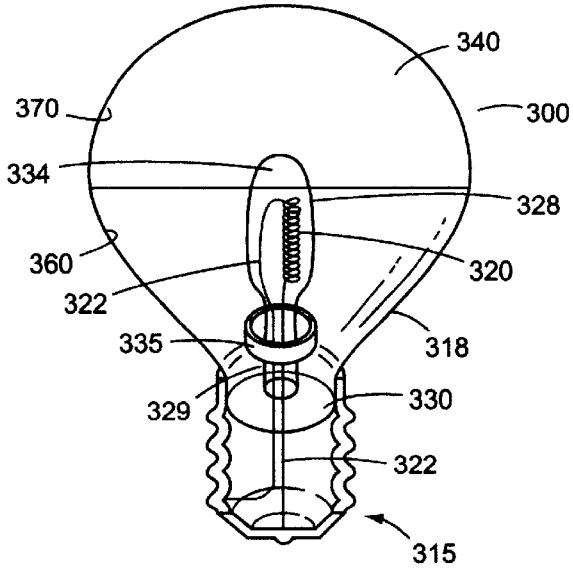
FIG. 6 is an exploded front elevational view on an enlarged scale of a modified embodiment of the lamp component of the invention.

Another embodiment of a lamp is shown in FIG. 6. In this modified lamp embodiment 300, the lamp has a base 315 secured to an outer bulb 318, a filament 320, and wiring 322 completing a circuit of the type well known in the art from the base 315 to the filament 320 and then from the other end of the filament back to the base. The two lead wires 322 are made to pass through an opening in inner bulb 328 which is preferably fabricated from quartz glass, and which inner bulb contains therein only a halogen gas 334. A stem 329 holds the inner bulb in place by being secured to the conventional glass seal 330 in the base to which seal the outer bulb 318 is also secured. The outer bulb itself is filled with an inexpensive inert gas 340 or air at a pressure of one atmosphere. The primary purpose of the outer bulb is to protect the inner bulb from accidentally being touched. Also secured to the exterior of the inner bulb, preferably at stem 329 is a disc member 335.

The metallic disc member 335 is affixed on the outside of stem 329 close to the base 315 by means well known in the art, such as by an adhesive or by a friction-fit. In the preferred embodiment of the invention, the disc member 335 is a thin aluminum disc preferably 1/64" thick and ill in diameter. The disc reflects heat back onto the filament, which then causes the temperature of the filament to increase. The increased temperature of the filament causes it to release more photons, which means that more light is produced than would otherwise by the case. More of this light is then reflected away from the lamp base.

Also on the interior surface of the bulb in the preferred embodiment of the invention is a reflective coating 360, with the reflective coating preferably extending from a place just beyond the filament 320 to the base of the bulb. This reflective coating 360 causes the light emitted towards the base to be reflected away from the base, so that more of the light actually emitted from the bulb is efficiently used. The remainder of the bulb surface may be coated with a coating 370, so that the bulb appears frosted or, as some refer to it, so that the light is softened.

With respect to the base 315, it should be appreciated that the modified embodiment of the invention also uses an E-17 base. Once again, this is to prevent the direct use of the lamp in a E-26, standard sized light socket, where it would burn out faster than intended.

It will be readily apparent from the foregoing detailed description of the preferred embodiment and the several modifications thereof that a particularly novel and extremely efficacious lightbulb is provided. The device is relatively simple to fabricate, however, it results in a device which provides a significant increase in the electrical efficiency of lightbulbs over bulbs previously known.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A lightbulb comprising a lamp, said lamp having a base and a bulb secured to said base, said base having connected thereto one end of a pair of lead wires, said lead wires having their opposite ends connected to a filament, said filament in contact with a gas, a portion of said pair of lead wires encircled by glass, said glass encircled by and having secured thereto a metallic disk, and a cap, said cap containing electrical circuitry to reduce the voltage fed into the lamp.

2. The lightbulb according to claim 1 wherein said cap is of a screw-type for placement in a screw style electrical socket.

3. The lightbulb according to claim 1 wherein said cap is of bayonet-type for placement in a bayonet style electrical socket.

4. The lightbulb according to claim 1 wherein said filament is a coiled coil, said filament also being supported by a plurality of support wires, each of said support wires having one end in contact with said filament and another end in contact with said glass which encircles said lead wires.

5. The lightbulb according to claim 4 wherein said glass comprises an inner stem and an outer stem.

6. The lightbulb according to claim 5 wherein said support wires are in contact with said inner stem, and said outer stem is secured to said base.

7. The lightbulb according to claim 1 wherein said gas is a mixture of an inert gas and a halogen gas.

8. The lightbulb according to claim 1 wherein said gas is a mixture of xenon and bromine.

9. The lightbulb according to claim 8 wherein the ratio of xenon to bromine is 98:2.

10. The lightbulb according to claim 1 wherein said glass is an inner bulb, said inner bulb secured to said base.

11. The lightbulb according to claim 10 wherein said inner bulb contains a halogen gas.

12. The lightbulb according to claim 11 wherein said bulb encases said inner bulb and metallic disk, said bulb containing an inert gas.

13. The lightbulb according to claim 11 wherein said bulb encases said inner bulb and metallic disk, said bulb containing air.

14. The lightbulb according to claim 1 wherein said cap comprises a housing having a switch to control the light output of said lamp.

15. The lightbulb according to claim 1 wherein said base is secured within said cap.

16. A lightbulb comprising a lamp, said lamp having a base and a bulb secured to said base, said base having connected thereto one end of a pair of lead wires, said lead wires having their opposite ends connected to a filament, said filament being a coiled coil, said filament being in contact with a gas, said gas being a mixture of an inert gas and halogen gas, a portion of said pair of lead wires being encircled by glass, said filament also being supported by a plurality of support wires, each of said support wires having one end in contact with said filament and another end in contact with said glass which encircles said lead wires, said glass comprising an inner stem and an outer stem, said support wires being in contact with said inner stem, and said outer stem being secured to said base, said glass encircled by and having secured thereto a metallic disk, and a cap, said cap containing electrical circuitry to reduce the voltage fed into the lamp.

17. The lightbulb according to claim 16 wherein said cap is of a screw-type for placement in a screw style electrical socket.

18. The lightbulb according to claim 16 wherein said cap is of bayonet-type for placement in a bayonet style electrical socket.

19. A lightbulb comprising a lamp, said lamp having a base and a bulb secured to said base, said base having connected thereto one end of a pair of lead wires, said lead wires having their opposite ends connected to a filament, said filament in contact with a gas, a portion of said pair of lead wires encircled by glass, said glass being an inner bulb containing a halogen gas, said inner bulb secured to said base, said glass encircled by and having secured thereto a metallic disk, said bulb encasing said inner bulb and metallic disk, and a cap, said cap containing electrical circuitry to reduce the voltage fed into the lamp.

* * * * *